United States Patent [19]

Haack

[11] 4,154,135

[45] May 15, 1979

[54] MUSICAL INSTRUMENT

[76] Inventor: Isabelle L. Haack, 2101 Dekoven Ave., Racine, Wis. 53403

[21] Appl. No.: 880,461

[22] Filed: Feb. 23, 1978

[51] Int. Cl.[2] ..... G10K 1/36; G10K 1/38

[52] U.S. Cl. ..... 84/406; 84/103

[58] Field of Search ..... 84/103, 402–407

[56] References Cited

U.S. PATENT DOCUMENTS

| | | | |
|---|---|---|---|
| 33,372 | 9/1861 | Williams et al. | 84/406 |
| 3,139,855 | 7/1964 | Kunz | 84/103 X |

*Primary Examiner*—Lawrence R. Franklin

*Attorney, Agent, or Firm*—Wegner, Stellman, McCord, Wiles & Wood

[57] ABSTRACT

A bell tower arranged to permit a single person to ring a substantial number of bells as in the playing of a musical selection. The bell tower includes a stand for supporting a plurality of bells suitably to be rung by the selective striking thereof as by a mallet or other ringing element. The instrument includes a control for selectively damping rung bells. The control may be foot pedal operated and may be arranged to damp selected groups of the bells of the tower. The bells may be supported on the tower stand to define octaves corresponding to the notes of a conventional piano keyboard. The respective octaves may be vertically related. The damping control may be biased to a damping disposition and selectively released by the user in the playing of the instrument.

9 Claims, 3 Drawing Figures

24
28
27
14
39
12
38
40
36
24
29
25
26
30
23
35
34
24
42
41
31
39
13
24
34
32
39
24
43
34
33
44

2
25
19
10
16
40
27
11
15
18
38
17
12
35
34
36
2
41
43
3
22
20
21
45
21
3

22
17
20
45

41
21
53
50
48
49
46
52
51
47

MUSICAL INSTRUMENT

BACKGROUND OF THE INVENTION

1. Field of the Invention

This invention relates to musical instruments and in particular to bells.

2. Description of the Prior Art

The ringing of bells in playing musical selections is one of the oldest forms of musical instrumentation. The playing of church tower bells is well known.

Another widespread use of bells is in the bell ringer groups wherein a group of people each provided with a pair of bells act in coordinated fashion to play musical selections utilizing a large range of notes. Bell ringing societies of this type are worldwide in scope.

SUMMARY OF THE INVENTION

The present invention comprehends an improved means for permitting the playing of a large number of bells so as to permit a single person to ring the bells as by striking the bells with a suitable ringing element, such as a mallet or the like.

The bell instrument effectively comprises a bell tower having a stand supporting a substantial number of bells, such as a sufficient number of bells corresponding to several octaves of the musical scale.

The bells may be arranged in horizontal rows with the octaves being vertically related for facilitated playing thereof.

The invention comprehends providing damping means for selectively damping the rung bells for improved presentation of the musical selection. In the illustrated embodiment, the damping means is controlled by a foot pedal means permitting the user's hands to be free in striking the bells in the playing of the musical selection.

The damping means may be arranged to damp a group of bells and in the illustrated embodiment, where two octaves of bells are provided, the damping means is arranged to selectively damp either of the two octaves.

In the illustrated embodiment, biasing means are provided in the form of springs for biasing the damping means to the bell damping position.

The bells may be hung on leather straps providing limited movement of the bells when rung. Constraining means may be provided for preventing undesirable movement of the bells by the damping means.

The bell tower of the present invention is extremely simple and economical of construction while yet providing a highly improved musical instrument as discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 2:
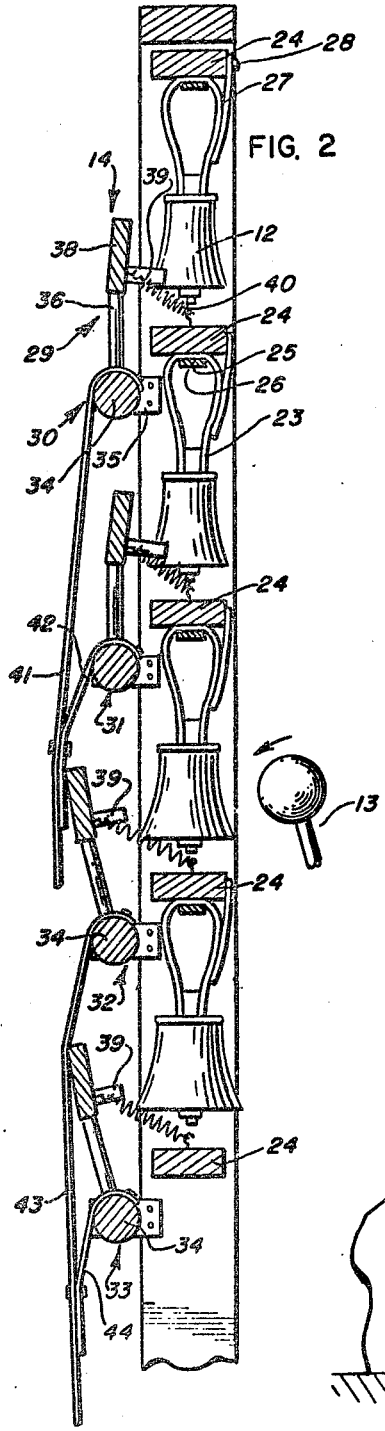
FIG. 2 is a fragmentary enlarged vertical section taken substantially along the line 2—2 of FIG. 1.

In the exemplary embodiment of the invention as disclosed in the drawing, a musical instrument generally designated 10 is shown to comprise a bell tower having a stand 11 and a plurality of bells generally designated 12 carried on the stand for selective playing as by a suitable ringing element, which illustratively may comprise a mallet 13.

Instrument 10 further includes a damping means generally designated 14 for selectively damping the rung bells as will be brought out more fully hereinafter.

In the illustrated embodiment, sufficient bells 12 are provided to define two complete octaves generally corresponding to the note arrangement of the conventional piano keyboard. Thus, as shown in FIG. 1, a first group of bells generally designated 15 corresponds to a first octave and a second group of bells generally designated 16 corresponds to a higher second octave so that the bells 12 cooperatively provide two octaves, it being understood any suitable larger or smaller bell provision is comprehended within the scope of the invention.

Figure 1:
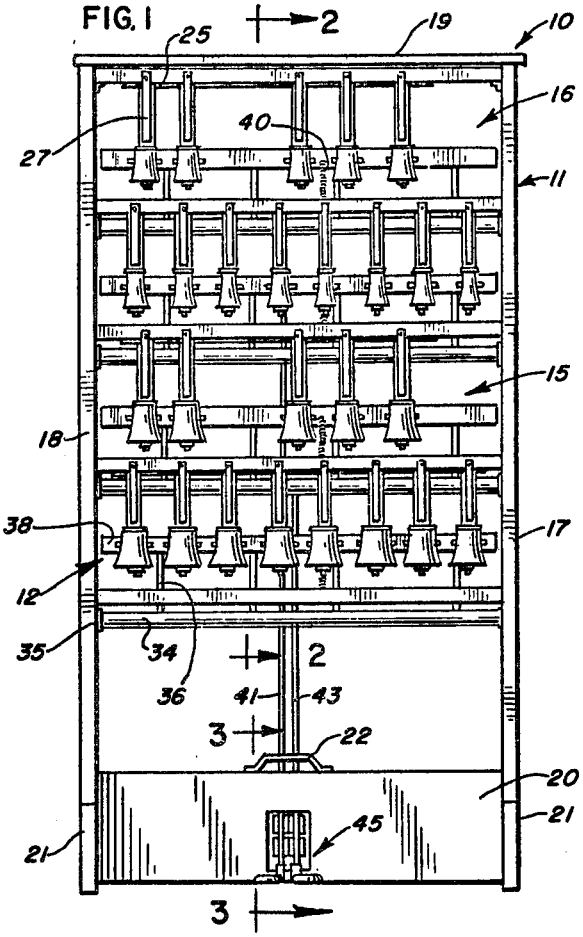
FIG. 1 is a front elevation of a bell tower embodying the invention.

As shown in FIG. 1, the higher octave 16 is positioned vertically above the lower octave 15.

Stand 11 includes a pair of side supports 17 and 18, a top crosspiece 19, and a cross baseboard 20. Foot members 21 are provided on the lower end of the side supports 17 and 18 for stabilizing the stand 11 in the upright position on a suitable subjacent surface, such as a horizontal floor or the like. As shown in FIG. 1, the baseboard 20 may be provided with a suitable carrying handle 22.

The respective bells are carried on suitable leather straps 23 which may be secured to transverse bars 24 extending between the stand side supports 17 and 18. Each of the straps is secured to the crossbars by suitable clips 25, which, in turn, may be secured to the crossbar by suitable screws 26.

As shown in FIG. 2, the straps are constrained against forward movement by metal constraining straps 27 which may be secured to the crossbars by suitable means, such as screws 28, and which extend downwardly forwardly of the straps in engagement therewith. The normal disposition of the respective bells, as shown in FIG. 2, is substantially vertical with the constraining straps 27 preventing forward movement of the bells substantially from the vertical disposition.

As indicated above, the instrument 10 includes an improved damping means 14 for selectively damping the bells in the playing of the instrument. More specifically, the damping means includes a plurality of damping assemblies generally designated 29 including an uppermost assembly 30, and progressively lower assemblies 31, 32, and 33. As shown in FIG. 2, each assembly is substantially similar including a rod 34 which is pivotally mounted about its axis to supports 35 carried on the opposite side supports 17 and 18 of the stand. Upstanding from the rod is a plurality of damper supports 36 carrying a damper bar 38 on which is mounted a plurality of dampers 39 which extend forwardly from the damper bar into damping engagement with the respective bells 12.

Extending between the damper bars 38 and the next subjacent crossbars 24 are springs 40 for biasing the dampers 39 against the bells, as seen in FIG. 2. As shown, each of the respective damping assemblies is similar and, thus, each of the dampers 39 is biased against its respective associated bell by the biasing means 40 defined by the springs.

As further shown in FIG. 2, the damping assemblies 30 and 31 are interconnected by straps 41 and 42, and the lower damping assemblies 32 and 33 are interconnected by straps 43 and 44. Straps 41 and 43 extend fully downwardly to behind the baseboard 20, as seen in FIG. 1, and are connected to a foot pedal means generally designated 45 mounted to the baseboard, as seen in FIGS. 1 and 3.

Foot pedal means 45 includes pair of foot pedals 46 and 47. Strap 41 is connected by a suitable clip 48 to foot pedal 46 and strap 43 is connected by a suitable clip 49 to foot pedal 47. The straps are entrained about a pair of rollers 50 carried in the foot members 21, as best seen in FIG. 3.

The respective pedals are hingedly connected by suitable hinges 51 to a lower portion 52 of the baseboard 20 defining the bottom of an opening 53 in the baseboard through which the straps 41 and 43 extend.

Figure 3:
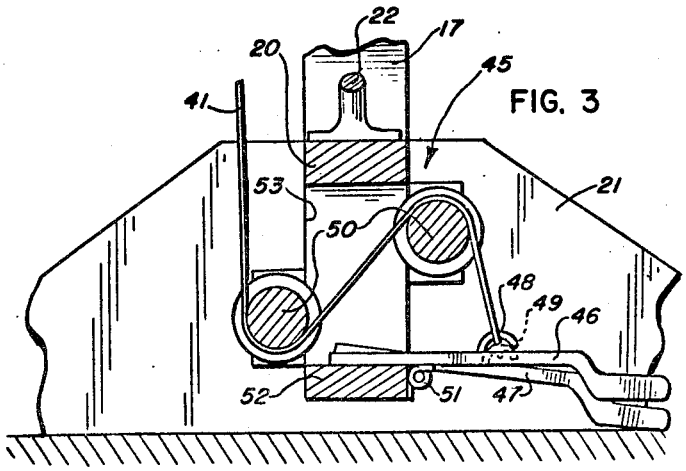
FIG. 3 is a fragmentary enlarged vertical section taken substantially along the line 3—3 of FIG. 1.

The springs 40 urge the straps upwardly so as to raise the foot pedals 46 and 47 to the upper position illustrated relative to foot pedal 46 in FIG. 3. Thus, in the normal arrangement of the foot pedals, the bells are damped by the dampers 39 and it is necessary for the operator to merely depress the foot pedal means to effect a release of the bells for effecting a ringing thereof as by striking of the selected bells with the mallet 13 illustrated in FIG. 2.

More specifically, as illustrated in FIGS. 2 and 3, the depression of foot pedal 47 pulls on the straps 43 and 44 so as to swing the rods 34 thereof in a counterclockwise direction thereby spacing the dampers 39 thereof from the respective bells of the lower octave 15. Suitable manipulation of the pedals may be effected by the user so as to effect the desired damping subsequent to the striking of the selected bells in either of the two octaves so as to provide controlled ringing of the bells in the playing thereof. It should be noted that the connection of straps 41 and 42 and the connection of straps 43 and 44 causes the entire octave to be damped by the depression of the associated foot pedal. The provision of the constraining strap 27 causes the bells to be effectively retained to be engaged by the dampers 39, as shown in FIG. 2, for improved damping operation effected by the biasing springs 40. When the foot pedals are operated so as to release the damping means from the bells, they are moved sufficiently rearwardly, as shown in the lower portion of FIG. 2, to permit free ringing of the bells. As discussed above, the leather straps 23 are relatively stiff so that only limited movement of the bells may be had upon the striking thereof by the mallet 13 and, thus, the bells are maintained spaced forwardly of the dampers 39 until such time as the foot pedal is released to effect the forward movement of the dampers to the damping position shown in the upper portion of FIG. 2 as discussed above.

The height of the stand 11 may be preselected so that a player sitting in a conventional chair may be able to reach each of the bells in the two octaves 15 and 16 with the feet of the player being suitably associated with the foot pedals 46 and 47 to effect the desired control of the damping means.

The musical instrument 10 is extremely simple and economical of construction while yet providing the facilitated controlled playing of a large playing of bells by a single player, thus providing an improved, novel instrument whereby a single player may play musical selections on a plurality of bells heretofore requiring a large number of people. The bell tower provides for facilitated playing of the bells and improved control of the damping thereof for providing further improved presentation of the musical selections.

The foregoing disclosure of specific embodiments is illustrative of the board inventive concepts comprehended by the invention.

I claim:

1. A musical instrument comprising:

a stand;

flexible means for freely supporting a plurality of bells suitably to be rung by the selective striking thereof with a ringing element;

means for damping said bells;

means acting on said flexible means for constraining movement of the bells to dispose the bells to be engaged by the damping means while permitting the bells to be freely hung on said flexible means when the damping means is spaced from the bells; and control means on said stand for selectively spacing the damping means from the bells to permit undamped ringing of selected bells and damping the rung bells.

2. The musical instrument of claim 1 wherein said control means includes a foot pedal for effecting selective operation thereof.

3. The musical instrument of claim 1 wherein the bells are hung on leather straps in preselected rows on said stand corresponding to two octaves of notes of a conventional piano keyboard, the higher musical octave being disposed above the lower musical octave.

4. The musical instrument of claim 1 wherein said bells are arranged in a plurality of groups, said damping means having a corresponding number of damping means each arranged to damp selectively only a corresponding one of said groups.

5. The musical instrument of claim 1 wherein said bells are arranged to define two groups, said damping means including two damping means portions, one damping means portion being arranged to selectively damp all of the bells of one of said groups and the other of said damping means portions being arranged to selectively damp all of the bells of the other of said groups.

6. The muscial instrument of claim 1 wherein said control means includes biasing means for causing the damping means to damp the bells.

7. The musical instrument of claim 1 wherein said control means includes biasing means for causing the damping means to damp the bells and selectively operable release means for overcoming the biasing means to permit ringing of the bells in an undamped mode.

8. The musical instrument of claim 1 wherein said damping means includes damping elements rearwardly engaging the bells and said control means comprises pedal operated means for selectively spacing the damping means from the bells when desired.

9. The musical instrument of claim 1 wherein the bells are hung on leather straps in preselected rows on said stand corresponding to a plurality of octaves of notes of a conventional piano keyboard.

* * * * *